US009602932B2

(12) United States Patent
Gudiksen et al.

(10) Patent No.: US 9,602,932 B2
(45) Date of Patent: Mar. 21, 2017

(54) RESOURCE MANAGER

(71) Applicant: GN ReSound A/S, Ballerup (DK)

(72) Inventors: Ole Gudiksen, Farum (DK); Karsten Filso Jorgensen, Skodsborg (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 14/195,549

(22) Filed: Mar. 3, 2014

(65) Prior Publication Data

US 2015/0245149 A1 Aug. 27, 2015

(30) Foreign Application Priority Data

Feb. 24, 2014 (DK) ..... 2014 00103
Feb. 24, 2014 (EP) ..... 14156438

(51) Int. Cl.
*H04R 1/02* (2006.01)
*H04R 25/00* (2006.01)
*H04R 5/00* (2006.01)

(52) U.S. Cl.
CPC ..... *H04R 25/554* (2013.01); *H04R 2225/55* (2013.01); *H04R 2460/07* (2013.01)

(58) Field of Classification Search
CPC ... H04R 25/554; H04R 25/556; H04R 25/558
USPC ..... 381/314, 315, 23.1; 718/100
See application file for complete search history.

(56) References Cited

U.S. PATENT DOCUMENTS 7,062,304 B2 * 6/2006 Chauvel ..... G06F 1/206 455/574
2005/0089183 A1 4/2005 Niederdrank et al.
2007/0269049 A1 11/2007 Glatt et al.
(Continued)

FOREIGN PATENT DOCUMENTS

EP 1460769 A1 9/2004
EP 2 200 207 A1 6/2010
(Continued)

OTHER PUBLICATIONS

Extended European Search Report dated Sep. 4, 2014, for related EP Patent Application No. 14156438.5, 7 pages.
(Continued)

*Primary Examiner* — Sunita Joshi
(74) *Attorney, Agent, or Firm* — Vista IP Law Group, LLP

(57) ABSTRACT

A hearing aid includes: an input transducer configured to output an audio signal based on a signal applied to the input transducer; a processor configured to compensate a hearing loss of a user of the hearing aid and to output a hearing loss compensated audio signal; an output transducer configured to output an auditory output signal based on the hearing loss compensated audio signal, wherein the auditory output signal is to be received by a human auditory system; a wireless communication unit; and an operating system configured to control the wireless communication unit to perform communication with one or more devices, wherein the operating system comprises a scheduler configured to receive communication requests associated with respective communication tasks and to schedule at least one of the communication tasks based on a task priority and a state of a power supply of the hearing aid.

18 Claims, 5 Drawing Sheets

(56) References Cited

U.S. PATENT DOCUMENTS

| | | | | |
|---|---|---|---|---|
| 2010/0157790 | A1* | 6/2010 | Pedersen | H04L 1/004 370/216 |
| 2010/0266151 | A1* | 10/2010 | Glatt | H04R 25/55 381/314 |
| 2011/0255722 | A1* | 10/2011 | Pedersen | 381/315 |

FOREIGN PATENT DOCUMENTS

| | | | |
|---|---|---|---|
| EP | 2 378 793 | A1 | 10/2011 |
| WO | WO 2004/110099 | A2 | 12/2004 |
| WO | WO 2007/132023 | A2 | 11/2007 |

OTHER PUBLICATIONS

Examination and Search Report dated May 7, 2014 in Application No. PA 2014 00103 (4 pages).
Second Technical Examination—Intention to Grant dated Nov. 24, 2014, for related Danish Patent Application No. PA 2014 00103, 2 pages.
European Intention to Grant dated Jul. 22, 2016 for corresponding EP Patent Application No. 14156438.5, 33 pages.

* cited by examiner

RESOURCE MANAGER

RELATED APPLICATION DATA

This application claims priority to and the benefit of Danish Patent Application No. PA 2014 00103 filed on Feb. 24, 2014, pending, and European Patent Application No. 14156438.5 filed on Feb. 24, 2014, pending. The entire disclosures of both of the above applications are expressly incorporated by reference herein.

FIELD OF TECHNOLOGY

A new hearing aid is provided that is configured to perform wireless communication with other devices while taking the state of a power supply of the hearing aid into account.

The wireless communication may be performed in a wireless network facilitating interconnection of a plurality of devices in the network, such as hearing aids, remote controllers, fitting instruments, mobile phones, headsets, door bells, alarm systems, broadcast systems, etc.

BACKGROUND

WO 2004/110099 discloses a hearing aid wireless network with a communication protocol that is simple thereby requiring a small amount of code and with low power consumption during operation. Further, the acquisition time is low, and the latency is low.

SUMMARY

A new hearing aid is provided that is capable of performing wireless communication in accordance with a plurality of different wireless communication protocols.

A new hearing aid is provided, comprising a hearing aid circuit with an input transducer configured to output an audio signal based on a signal applied to the input transducer and representing sound, a hearing loss processor configured to compensate a hearing loss of a user of the hearing aid and output a hearing loss compensated audio signal, e.g., the hearing aid may aim to restore loudness, such that loudness of the applied signal as it would have been perceived by a normal listener substantially matches the loudness of the hearing loss compensated signal as perceived by the user, an output transducer, such as a receiver, an implanted transducer, etc., configured to output an auditory output signal based on the hearing loss compensated audio signal that can be received by the human auditory system, whereby the user hears the sound, and a wireless communication unit configured to communicate with another device.

A power supply is connected to supply power to the hearing aid circuit.

The hearing aid may further comprise a processor with an operating system configured to manage hearing aid hardware and software resources, e.g. including the hearing loss processor and possible other processors and associated signal processing algorithms, the wireless communication unit, memory resources, the power supply, etc., and to provide common services for tasks to be performed. The operating system may schedule tasks for efficient use of the hearing aid resources and may also include accounting software for cost allocation, including power consumption, of processor time, storage, wireless transmissions, and other resources.

For various tasks, such as wireless communication and memory allocation, the operating system acts as an intermediary between the tasks and the hearing aid circuit although the application code of the tasks is usually executed directly by appropriate hearing aid processing circuitry and will frequently make a system call to an operating system function or be interrupted by it.

The processor may be the hearing loss processor, or, the wireless communication unit may include the processor with the operating system, or the operating system may be distributed between various processors, such as the hearing loss processor and a processor of the wireless communication unit and possibly one or more further processors.

In particular, the operating system may be configured to control the wireless communication unit to perform communication with other devices in accordance with a plurality of communication protocols and priorities of the communication tasks.

The operating system may comprise a scheduler, or the operating system may be constituted by a scheduler. The scheduler may be configured to receive communication requests from communication tasks and may schedule each of the communication tasks based on task priorities and a state of the power supply, such as a de-charged state of a battery of the power supply and/or of a capacitor of the hearing aid circuit.

A new method is also provided of scheduling wireless communication of a hearing aid comprising a hearing aid circuit with an input transducer configured to output an audio signal based on a signal applied to the input transducer and representing sound, a hearing loss processor configured to compensate a hearing loss of a user of the hearing aid and output a corresponding hearing loss compensated audio signal, an output transducer configured to output an auditory output signal based on the hearing loss compensated audio signal that can be received by the human auditory system resulting in the user hearing sound, a wireless communication unit configured to communicate with another device, a power supply connected to supply power to the hearing aid circuit, and an operating system configured to control the wireless communication unit to communicate with other devices in accordance with respective communication protocols and priorities.

The new method may comprise receiving communication requests from communication tasks, and scheduling the communication tasks based on task priorities and a state of the power supply.

A transducer is a device that converts a signal applied to the transducer in one form of energy to a corresponding output signal in another form of energy.

The input transducer may comprise a microphone that converts an acoustic signal applied to the microphone into a corresponding analogue audio signal in which the instantaneous voltage of the audio signal varies continuously with the sound pressure of the acoustic signal.

The input transducer may also comprise a telecoil that converts a varying magnetic field at the telecoil into a corresponding varying analogue audio signal in which the instantaneous voltage of the audio signal varies continuously with the varying magnetic field strength at the telecoil. Telecoils may be used to increase the signal to noise ratio of speech from a speaker addressing a number of people in a public place, e.g. in a church, an auditorium, a theatre, a cinema, etc., or through a public address systems, such as in a railway station, an airport, a shopping mall, etc. Speech from the speaker is converted to a magnetic field with an induction loop system (also called "hearing loop"), and the telecoil is used to magnetically pick up the magnetically transmitted speech signal.

The input transducer may further comprise at least two spaced apart microphones, and a beamformer configured for combining microphone output signals of the at least two spaced apart microphones into a directional microphone signal.

The input transducer may comprise one or more microphones and a telecoil and a switch, e.g. for selection of an omni-directional microphone signal, or a directional microphone signal, or a telecoil signal, either alone or in any combination, as the audio signal.

Typically, the analogue audio signal is made suitable for digital signal processing by conversion into a corresponding digital audio signal in an analogue-to-digital converter whereby the amplitude of the analogue audio signal is represented by a binary number. In this way, a discrete-time and discrete-amplitude digital audio signal in the form of a sequence of digital values represents the continuous-time and continuous-amplitude analogue audio signal.

Throughout the present disclosure, the "audio signal" may be used to identify any analogue or digital signal forming part of the signal path from the output of the input transducer to an input of the hearing loss processor.

Throughout the present disclosure, the "hearing loss compensated audio signal" may be used to identify any analogue or digital signal forming part of the signal path from the output of the hearing loss processor to an input of the output transducer possibly via a digital-to-analogue converter.

The wireless communication unit may comprise a transceiver.

The wireless communication unit may be a device or a circuit comprising both a wireless transmitter and a wireless receiver. The transmitter and receiver may share common circuitry and/or a single housing. Alternatively, the transmitter and receiver may share no circuitry, and the wireless communication unit may comprise separate devices with the transmitter and the receiver, respectively.

The wireless communication may be performed according to a frequency diversification or spread spectrum scheme, i.e. the frequency range utilized by the hearing aid is divided into a number of frequency channels, and wireless transmissions switch channels according to a predetermined scheme so that transmissions are distributed over the frequency range.

A frequency hopping algorithm may be provided that allows devices in the network to calculate what frequency channel the network will use at any given point in time without relying on the history of the network, e.g. based on the present frequency channel number, a pseudo-random number generator calculates the next frequency channel number. This facilitates synchronization of a new device with the hearing aid, e.g. the new device comprises the same pseudo-random number generator as the hearing aid. Thus, upon receipt of the current frequency channel number during acquisition, the new device will calculate the same next frequency channel number as the hearing aid.

Every device in the network has its own identification number, e.g. a 32-bit number. Globally unique identities are not required since the probability of two users having hearing aids with identical identifications is negligible.

Preferably, a new device is automatically recognized by the network and interconnected with the network.

It is an advantage of a network operating according to a spread spectrum scheme that the communication has a low sensitivity to noise, since noise is typically present in specific frequency channels, and communication will only be performed in a specific frequency channel for a short time period after which communication is switched to another frequency channel.

Further, several networks may co-exist in close proximity, for example two or more hearing aid users may be present in the same room without network interference, since the probability of two networks simultaneously using a same, specific frequency channel will be very low. Likewise, the hearing aid network may coexist with other wireless networks utilizing the same frequency band, such as Bluetooth networks or other wireless local area networks.

The hearing aid may advantageously be incorporated into a binaural hearing aid system, wherein two hearing aids are interconnected, e.g., through a wireless network, for digital exchange of data, such as audio signals, signal processing parameters, control data, such as identification of signal processing programs, etc., etc., and optionally interconnected with other devices, such as a remote control, etc.

Typically, only a limited amount of power is available from the power supply of a hearing aid. For example, power is typically supplied from a conventional $ZnO_2$ battery in a hearing aid.

In the design of a hearing aid, the size and the power consumption are important considerations. The size of a hearing aid is dependent on the size of the battery used, and to ensure compact and inconspicuous hearing aids, small battery sizes, such as the types "312" and "13", are used. However, small batteries have a relatively large internal resistance. For example, a "312" battery typically have an internal resistance of 5 ohm which is two orders of magnitude higher than an internal resistance of an AA type battery. The high internal resistance leads to significant drop in output voltage at increased output current. This may be critical for the operation of parts of the hearing aid circuit.

The wireless communication unit of the hearing aid may be comprised in a radio chip, such as the Nordic Semiconductor radio chip "nRF24I01", commonly operating at voltages above those available in a conventional $ZnO_2$ battery. Therefore it may be required to supply power to the radio chip via a voltage doubler (voltage amplifier). Furthermore, a radio chip draws significant amounts of current during transmission and reception. A conventional $ZnO_2$ battery is only capable of supplying the required amount of current drawn by the wireless communication unit during transmission and reception for a limited time period, typically 1 millisecond. In the event that the battery continues to supply the required amount of current for longer time periods, the supply voltage will decrease, and below a certain threshold, the hearing aid circuitry, in particular digital parts of the hearing aid circuitry, will not operate properly.

Further, the $ZnO_2$ battery will require time to recover after having supplied current, even for limited time periods, to the radio chip during communication. Typically, the radio chip duty cycle, i.e. the percentage of radio turn-on time with respect to the sum of the radio turn-on and radio turn-off time, must be kept below 10%.

This problem may be alleviated by connection of a circuit with a resistor and a capacitor between the power supply of the hearing aid circuit and a supply voltage input of the wireless communication unit, e.g. between the output of the voltage doubler and a power supply input of the radio chip. The capacitor will deliver peak currents to the wireless communication unit so that peak currents drawn from the power supply is lowered, and the resistor will limit currents drawn from the power supply by the wireless communication unit during capacitor voltage drops.

The scheduler may be configured to calculate an earliest possible start time for performing a next communication task based on an estimated power consumption of the current or most recent communication task, in order to provide a recovery time period for the power supply, such as the above-mentioned battery and/or capacitor, between finalization of the current or most recent communication task and start of the next communication task.

The recovery time period to be applied after finalization of a communication task performed by the wireless communication unit may be calculated as a constant multiplied by an estimate of a duration, or an actual duration, of the communication task performed by the wireless communication unit.

The estimated duration may be constituted by the added time periods of pre-processing, transmission, reception, and post-processing of the communication task.

The actual duration may be constituted by the added time periods during which the wireless communication unit is actually powered during the execution of the communication task. Thus, possible powered down periods of the wireless communication unit during execution of the communication task do not add to the recovery time period, when the actual duration is used for calculation of the recovery time period.

The constant may range from 0.5 to 2, preferably from 0.6 to 1.8, more preferred from 0.7 to 1.5, most preferred from 0.8 to 1.4. For example, the constant may be equal to 1.125.

The recovery time period to be applied after finalization of a communication task performed by the wireless communication unit may be calculated from the charge or current drawn from the power supply during performance of the communication task.

The scheduler may take battery state, i.e. the state of de-charge of the battery, into account when calculating the recovery time period. For example, the above-mentioned constant may be increased as a function of a de-charged state of the battery.

The communication request may contain a priority of the communication task.

The communication request may contain a requested start time for performing the requested communication task.

The communication request may contain duration of performing the requested communication task.

The scheduler may determine that the requested start time is not available and may communicate to the requesting task that another start time has to be requested.

The scheduler may determine that an already scheduled task cannot be performed at the scheduled start time, e.g. due to a request with a higher priority, and may communicate to the already scheduled task that a new start time must be requested.

The scheduler may be configured to allow a communication task with a lower priority to perform communication before a communication task with a higher priority provided that the communication task with the lower priority will finalize its communication in time for the associated recovery time period of the lower priority task to elapse before start of the communication task with the higher priority.

The scheduler may also schedule other tasks than wireless communication tasks, and thus, the scheduler may be configured to receive task requests from other tasks than wireless communication tasks and may schedule each of the tasks according to task priorities and a state of the power supply.

The scheduler may also take power consumption of other tasks than wireless communication into account when scheduling. Examples of other tasks include power consuming algorithms, storage in flash memory, etc. The recovery time period for such other tasks may be calculated in the same way as explained above with relation to the recovery time period for wireless communication tasks. The constant may be different for different types of tasks, e.g. due to differences in power consumption.

The scheduler may be configured to power down one or more parts of the hearing aid circuit to avoid excessive power consumption due to simultaneous operation of power consuming circuits.

For example, the scheduler may be configured to turn off the wireless communication unit for a sleep time period, e.g. during writing to and/or reading from a flash memory, during performance of power consuming algorithms, etc.

Preferably, the scheduler is configured to schedule one next start time of each requested task, i.e. the scheduler is not configured to schedule a plurality of start times for a given task even though a plurality of start times may easily be determined, or already has been determined, for repeated performance of the given task, e.g. streaming audio. In this way, the number of scheduled task is kept low, whereby the scheduler is kept simple and dynamic since little re-scheduling will be required in response to a new request.

In the event that a communication task is finalized or terminated earlier than scheduled, the scheduler may be configured to re-calculate the recovery time period based on the actual duration and/or the actual power consumption of the communication task in question. After elapse of the re-calculated recovery time period and until the scheduled start time for the next scheduled task, there may be sufficient time to execute another task, and as mentioned above, the scheduler may be configured to allow another task, even with a lower priority than the next scheduled task, to be performed provided that the task will finalize in time for the associated recovery time period to elapse before start of the next scheduled task.

Signal processing in the new hearing aid may be performed by dedicated hardware or may be performed in one or more signal processors, or performed in a combination of dedicated hardware and one or more signal processors.

A protocol is a system of digital rules for data exchange within or between devices, e.g. in a network. A protocol defines the syntax, semantics, and synchronization of communication. A protocol can be implemented in hardware, software, or both.

A communication task includes the actions required to perform communication, e.g. transmission of a data package to the hearing aid. A communication request may be performed by another device or a processor in the hearing aid requiring co-operation with the communication unit of the hearing aid.

As used herein, the terms "processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "signal processor", "controller", "system", etc., designate both an application running on a processor and a hardware processor. One or more "processors", "signal processors", "controllers", "systems" and the like, or any combination hereof, may reside within a process and/or thread of execution, and one or more "processors", "signal processors", "controllers", "systems", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing aid includes: an input transducer configured to output an audio signal based on a signal applied to the input transducer; a processor configured to compensate a hearing loss of a user of the hearing aid and to output a hearing loss compensated audio signal; an output transducer configured to output an auditory output signal based on the hearing loss compensated audio signal, wherein the auditory output signal is to be received by a human auditory system; a wireless communication unit; and an operating system configured to control the wireless communication unit to perform communication with one or more devices, wherein the operating system comprises a scheduler configured to receive communication requests associated with respective communication tasks and to schedule at least one of the communication tasks based on a task priority and a state of a power supply of the hearing aid.

Optionally, the hearing aid further includes a capacitor for supplying current to the wireless communication unit.

Optionally, the hearing aid further includes the power supply, and a resistor connected between the power supply and the capacitor.

Optionally, the scheduler is configured to calculate an earliest possible start time for performing a next communication task based on an estimated power consumption of a current or most recent communication task in order to provide a recovery time period for the power supply.

Optionally, the recovery time period is a constant multiplied by duration of the current or most recent communication task.

Optionally, the recovery time period is a function of a current drawn from the power supply during performance of the current or most recent communication task.

Optionally, the power supply comprises a battery, and wherein the recovery time period is a function of a state of the battery.

Optionally, at least one of the communication requests contains a priority of one of the communication tasks.

Optionally, at least one of the communication requests contains a start time for performing one of the communication tasks.

Optionally, at least one of the communication requests contains a duration of performance for one of the communication tasks.

Optionally, the scheduler is configured to allow one of the communication tasks with a lower priority to be performed before another one of the communication tasks with a higher priority, provided that the one of the communication tasks with the lower priority will be completed in time for an appropriate recovery time period of the power supply to elapse before start of the other one of the communication tasks with the higher priority.

Optionally, the scheduler is configured to turn off the communication unit for a sleep time period.

Optionally, the scheduler is configured to generate a communication indicating that another start time is needed to be requested if a requested start time for one of the communication tasks is not available.

Optionally, the scheduler is configured to generate a communication indicating that a new start time is needed to be requested if an already scheduled task cannot be performed at a scheduled start time.

Optionally, the scheduler is configured to also take power consumption of other tasks than wireless communication into account when scheduling.

Optionally, at least a part of the operating system is contained in the processor.

A method of scheduling wireless communication of a hearing aid includes: receiving communication requests associated with respective communication tasks, wherein the act of receiving the communication requests is performed by a scheduler in the hearing aid; and scheduling at least one of the communication tasks to be performed using a wireless communication unit in the hearing aid, wherein the scheduling is performed based on a task priority and a state of a power supply of the hearing aid.

Other aspects and features will be evident from reading the following detailed description.

BRIEF DESCRIPTION OF THE DRAWINGS

In the following, the new method and hearing aid is explained in more detail with reference to the drawings, wherein FIG. 1 Schematically illustrates a hearing aid according to the appended claims communication in a wireless network, FIG. 2 Is a schematic diagram of one new hearing aid according to the appended claims, FIG. 3 Illustrates slots and frames, FIG. 4 Illustrates various task requests, and FIG. 5 Shows a booking list and a list of prioritized tasks.

DETAILED DESCRIPTION OF EMBODIMENTS

Figure 1:
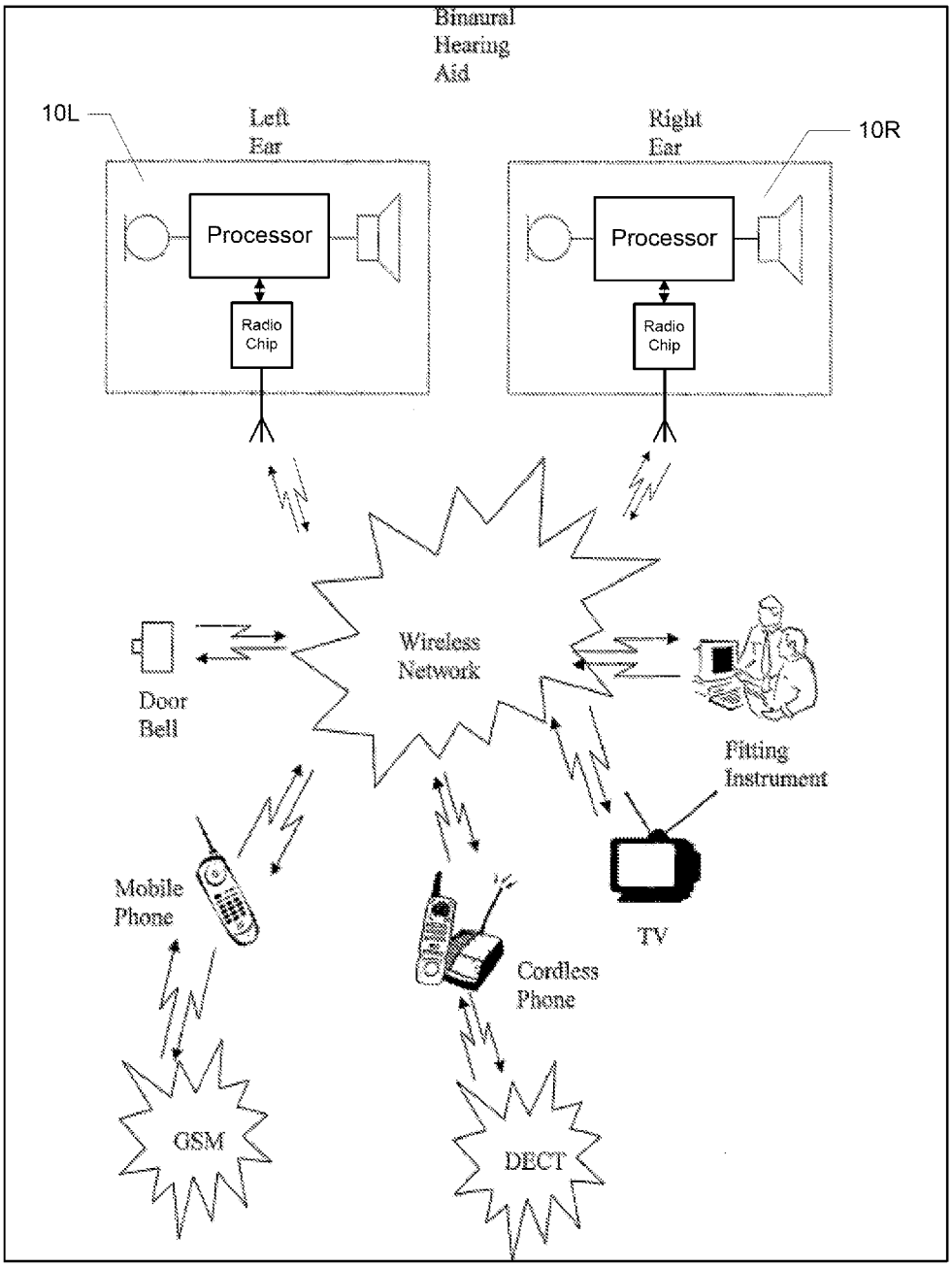

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In the following, various examples of the new method and hearing aid are illustrated. The new method and hearing aid according to the appended claims may, however, be embodied in different forms and should not be construed as limited to the examples set forth herein.

FIG. 1 schematically illustrates a binaural hearing aid 10L, 10R with a left ear hearing aid 10L and a right ear hearing aid 10R, each of which has a wireless communication unit for connection with a wireless network interconnecting the two hearing aids, and interconnecting the hearing aids 10L, 10R and a plurality of other devices in the wireless network. In the example illustrated in FIG. 1, a doorbell, a mobile phone, a cordless phone, a TV-set, and a fitting instrument are also connected to the wireless network.

An ID identifies every device. The ID is unique within the network.

The illustrated hearing aid network of FIG. 1 operates in the 2.4 GHz industrial scientific medical (ISM) band. It comprises 80 frequency channels of 1 MHz bandwidth. A frequency hopping time division multiplexing scheme is utilized. During acquisition, the frequency hopping scheme comprises a reduced number of frequency channels, e.g. less than 16 channels, preferably 8 channels, for faster acquisition. Members of the reduced set of frequency channels are denoted acquisition channels. Preferably, the acquisition channels are distributed uniformly throughout the frequency band utilised by the network.

Figure 2:
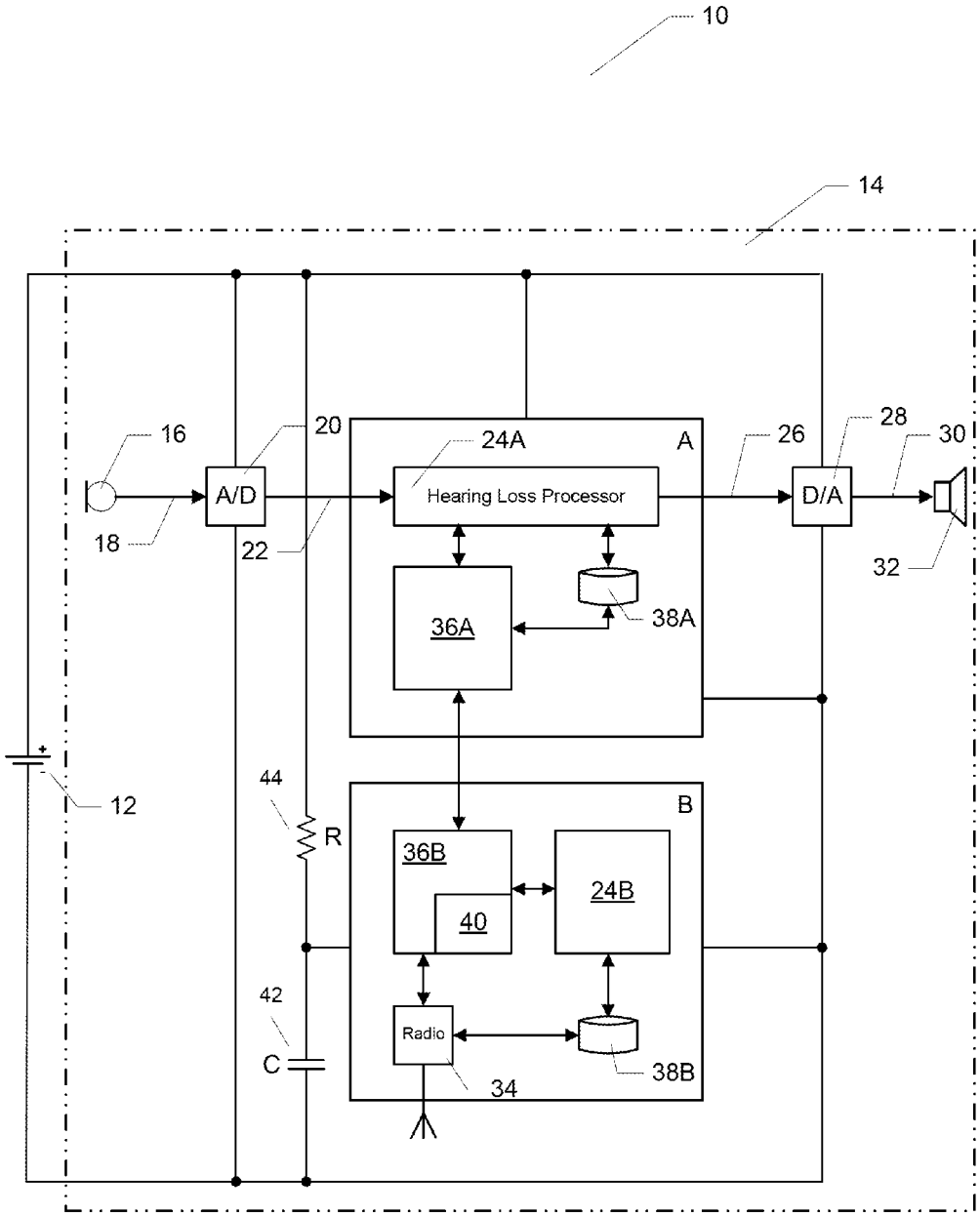

FIG. 2 shows a schematic diagram of a new hearing aid 10.

The hearing aid 10 has a $ZnO_2$ 12 battery that is connect for supplying power to the hearing aid circuit 14.

The hearing aid circuit 14 includes an input transducer 16 in the form of a microphone 16. The microphone 16 outputs an analogue audio signal 18 based on an acoustic sound signal arriving at the microphone 16 when the hearing aid 10 is operating.

An analogue-to-digital converter 20 converts the analogue audio signal 18 into a corresponding digital audio signal 22 for digital signal processing in the hearing aid circuit 14, in particular, in a hearing loss processor 24A that is configured to compensate a hearing loss of a user of the hearing aid 10. Preferably, the hearing loss processor 24A comprises a dynamic range compressor well-known in the art for compensation of frequency dependent loss of dynamic range of the user often termed recruitment in the art. Accordingly, the hearing loss processor 24A outputs a digital hearing loss compensated audio signal 26. The hearing aid may be configured to restore loudness, such that loudness of the hearing loss compensated signal as perceived by the user wearing the hearing aid 10 substantially matches the loudness of the acoustic sound signal arriving at the microphone 16 as it would have been perceived by a listener with normal hearing.

A digital-to-analogue converter 28 converts the digital hearing loss compensated audio signal 26 into a corresponding analogue hearing loss compensated audio signal 30.

An output transducer in the form of a receiver 32 converts the analogue hearing loss compensated audio signal 30 into a corresponding acoustic signal for transmission towards an eardrum of the user, whereby the user hears the sound arriving at the microphone; however, compensated for the user's individual hearing loss.

The hearing loss processor 24A forms part of a processor A executing a part 36A of the operating system 36A, 36B of the hearing aid, and a memory 38A.

The hearing aid circuit 14 further includes a wireless communication unit B with a radio 34 that is configured to communicate wirelessly with other devices in a hearing aid network as illustrated in FIG. 1 for a binaural hearing aid system. The wireless communication unit B includes a processor executing a part 36B of the operating system 36A, 36B of the hearing aid, and a memory 38B and a processor 24B performing the various communication protocols and other tasks.

The operation of the hearing aid 10 is controlled by the operating system 36A, 36B. The operating system 36A, 36B is configured to manage hearing aid hardware and software resources, e.g. including the hearing loss processor 24A and possible other processors and associated signal processing algorithms, the wireless communication unit B, memory resources 38A, 38B, the power supply 12, etc., and the operating system 36A, 36B allocates the hearing aid resources to the tasks to be performed.

The operating system 36A, 36B schedule tasks for efficient use of the hearing aid resources and may also include accounting software for cost allocation, including power consumption, processor time, memory locations, wireless transmissions, and other resources.

For various tasks, such as wireless communication and memory allocation, the operating system acts as an intermediary between the tasks and the hearing aid circuit hardware although the application code of the tasks is usually executed directly by appropriate parts of the hearing aid circuit and will frequently make system calls to respective operating system functions or be interrupted by it.

In particular, the operating system 36B controls the radio 34 to perform wireless communication with other devices in accordance with various respective communication protocols and priorities of the various respective communication tasks.

The operating system 36B comprises a scheduler 40 that receives requests, including communication requests, from tasks to be performed. A communication request includes a priority of the communication task, a requested start time for performing the requested communication task, and expected duration of performing the requested communication task.

In response to the task requests, the scheduler 40 schedules each of the tasks based on task priorities and a de-charged state of a capacitor 42 supplying power to the radio 34 and being re-charged by the battery 12 through a resistor 44.

The circuit with the resistor 44 and the capacitor 42 may be omitted, i.e. the resistor 44 may be substituted with a short-circuit and the capacitor 42 may be substituted by an open-circuit, and in this case, in response to the task requests, the scheduler 40 schedules each of the tasks based on task priorities and a de-charged state of the battery 12.

The scheduler 40 calculates an earliest possible start time for performing a next communication task based on an estimated power consumption of the current or most recent communication task, in order to provide a recovery time period for the power supply, in the illustrated example the combination of the battery 12 and the capacitor 42, between finalization of the current or most recent communication task and start of the next communication task.

The recovery time period to be applied after finalization of a communication task performed by the radio 34 may be calculated as a constant multiplied by an estimate of the duration, or the actual duration, of the communication task performed by the radio 34.

The estimated duration may be constituted by the added time periods of pre-processing, transmission, reception, and post-processing of the communication task.

The actual duration may be constituted by the added time periods during which the radio 34 is actually powered during the execution of the communication task. Thus, possible powered down periods of the radio 34 during execution of the communication task do not add to the recovery time period, when the actual duration is used for calculation of the recovery time period.

In the illustrated hearing aid 10, the constant may be equal to 1.125.

In another example, the recovery time period to be applied after finalization of a communication task performed by the radio 34 may be calculated from the charge or current drawn from the power supply during performance of the communication task.

Further, the scheduler 40 may take power supply state, i.e. the state of de-charge of the battery 12 and/or the capacitor 42, into account when calculating the recovery time period. For example, the above-mentioned constant may be increased as a function of de-charge of the battery 12.

The scheduler 40 may determine that the requested start time is not available and may communicate to the requesting task that another start time has to be requested.

The scheduler 40 may determine that an already scheduled task cannot be performed at the scheduled start time, e.g. due to an incoming request with a higher priority, and may communicate to the already scheduled task that a new start time must be requested.

The scheduler 40 may be configured to allow a communication task with a lower priority to perform communication before a communication task with a higher priority provided that the communication task with the lower priority will finalize its communication in time for the associated recovery time period to elapse before start of the communication task with the higher priority. This may for example be useful in the event that a task is terminated or finalized in shorter time than the requested duration. This may leave room for another task to be executed before start of the next scheduled task.

The scheduler 40 may also take power consumption of other tasks than wireless communication into account when scheduling. Examples of other tasks include power consuming algorithms, storage in flash memory, etc. The recovery time period for such other tasks may be calculated in the same way as explained above with relation to the recovery time period for wireless communication tasks. The constant may be different for different types of tasks, e.g. due to differences in power consumption.

The scheduler 40 may be configured to power down one or more parts of the hearing aid circuit to avoid excessive power consumption due to simultaneous operation of power consuming circuits, such as the radio 34, flash memory, signal processors executing signal processing algorithms, etc.

For example, the scheduler 40 may be configured to turn off the radio 34 for a sleep time period, e.g. during writing to and/or reading from a flash memory, during performance of power consuming algorithms, etc.

Preferably, the scheduler 40 is configured to schedule the next start time of each task only, i.e. the scheduler 40 is not configured to schedule a sequence of start times for a given task even though a plurality of start times may easily be determined, or already have been determined, for repeated performance of the given task, e.g. streaming audio. In this way, the number of scheduled task is kept low, whereby the scheduler 40 is kept simple and dynamic since little re-scheduling will be required in response to a new request.

In the event that a communication task is finalized or terminated earlier than scheduled, the scheduler 40 may be configured to re-calculate the recovery time period based on the actual duration and/or the actual power consumption of the communication task in question. After elapse of the re-calculated recovery time period and until the scheduled start time for the next scheduled task, there may be sufficient time to execute another task, and as mentioned above, the scheduler 40 may be configured to allow another task, even with a lower priority than the next scheduled task, to be performed provided that the lower priority task will finalize in time for the associated recovery time period of the lower priority task to elapse before start of the next scheduled task.

Figure 3:
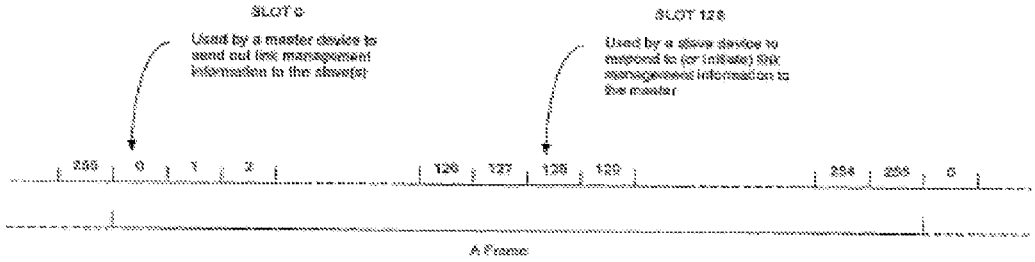

One exemplary protocol is illustrated in FIG. 3, wherein the time is divided into so-called slots that have a length of 1250 μs (twice the length of a minimum Bluetooth™ slot). The slots are numbered from 0 to 255.

256 slots, i.e. slot 0 to slot 255, constitute a frame. Frames are also numbered.

Among factors influencing selection of the length of a slot, is the required lower latency of the system and a desired low overhead with respects to headers and Phase-Locked-Loop (PLL) locking.

Preferably, the slot length is a multiple of 625 μS, facilitating (i.e. does not prevent) that the protocol according to one or more embodiments described herein can be implemented on BLUETOOTH™ enabled devices.

Each slot (except slot 128) is used for transmission by one specific device so that data collisions inside the network are prevented. Any slave device may transmit data in slot 128 and hence collisions may occur in this slot. The master device transmits timing information in slot 0. The slot and frame counters of a slave device are synchronized with the respective counters of the master device of the network.

A device may use one or more slots for transmission of data. Slots may be allocated during manufacture of a given device, or, slots may be allocated dynamically during acquisition. Preferably, the allocation table is stored in the master device.

Figure 4:
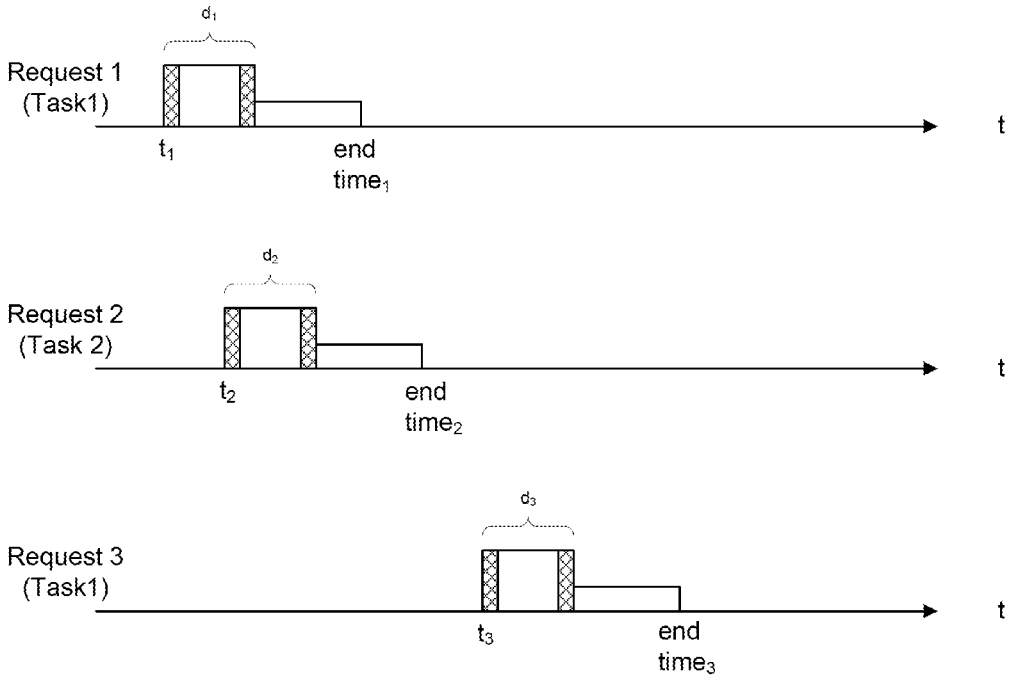
Figure 5:
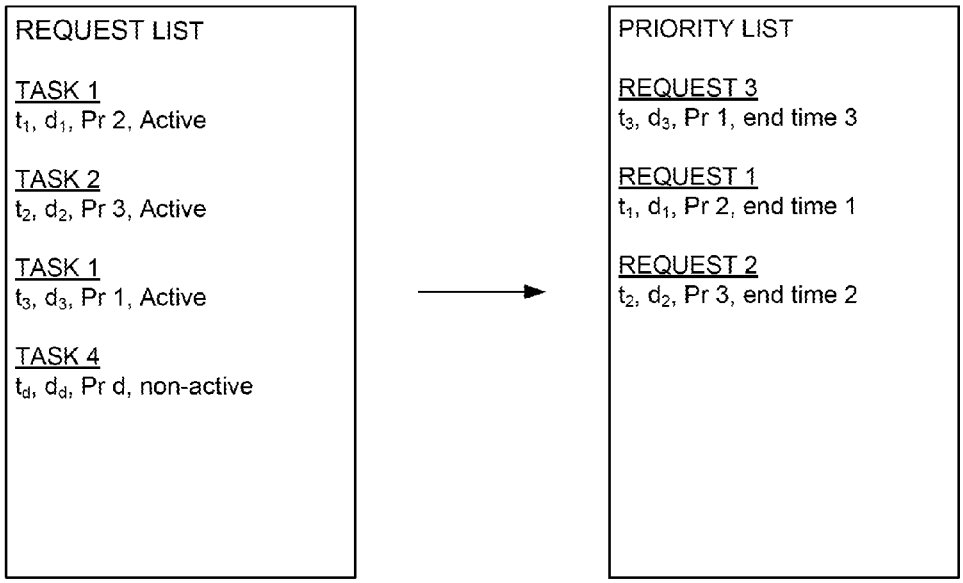

Operation of the scheduler 40 is illustrated in FIGS. 4 and 5.

FIG. 4 illustrates communication requests made by two communication tasks, namely Task 1 and Task 2. Task 1 may be a communication task relating to audio streaming, e.g. from a TV-set to the hearing aid performed in accordance with a hearing aid network communication protocol, and Task 2 may be a communication task relating to communication between a smart phone and the hearing aid performed in accordance with a Bluetooth Low Energy protocol. Each communication request contains start time, duration, and priority of the communication task to be performed. The duration includes pre-processing, transmission, reception, and post-processing of the communication task. In FIG. 4, the hatched areas indicate pre-processing and post-processing.

In the illustrated example, communication task 1 has made two communication requests so that audio data can be re-transmitted in the event that a first transmission (request 1) does not succeed. The second request has been made with high priority so that the probability of performing the second communication task at the requested time is high. In the example of FIG. 4, Communication task 1 has priority 2, communication task 2 has priority 3, and communication task 3 has priority 1. The highest priority has the lowest priority number.

Having received the communication requests, the scheduler 40 calculates the end times for each communication request as the sum of the requested duration d and the recovery time period allowing for power supply recovery. In the illustrated example, the recovery time period is equal to 9/8 times the duration.

Thus, end $time_1=t_1+d_1+9/8*d_1$ and end $time_2=t_2+d_2+9/8*d_2$ and end $time_3=t_3+d_3+9/8*d_3$.

Some communication tasks may not be active. For example, the remote controller may not have been used for some time. Active and non-active tasks are flagged as indicated in the Request List shown in FIG. 5. The parameters of a non-active task may be the now obsolete parameters of the most recent communication request.

As shown in FIG. 5, the scheduler 40 now schedules the communication tasks in accordance with the Request List and forms the shown priority list by listing the active communication requests in order of priority. Then, the scheduler identifies tasks with requests having end times earlier than the start time of the communication task with the highest priority (communication request 3 in the illustrated example). In the illustrated example, both communication request 1 and communication request 2 have end times earlier than $t_3$, in such a way that one of the corresponding tasks could be performed before start of the task with communication request 3. In this case, the communication task with the highest priority, namely the task with communication request 1 is performed.

In the event that the task with communication request 1 is performed successfully, the scheduler 40 deletes communication request 3, i.e. the second booking of communication task 1, since the audio data has now been successfully communicated. The scheduler 40 also determines that communication task 2 cannot be performed at the requested time; since end $time_1$ is larger than $t_2$, and a message is send to the requesting task that a new communication request must be made.

In the event that communication task 1 ends shortly after $t_1$, e.g. in the event that no header is detected due to noise, then a new end time is calculated based on a updated calculation of a correspondingly shorter recovery time, and in the event that the start time $t_2$ of communication request 2 is later than the new end time of communication task 1, then communication task 2 is performed because end $time_2$ is before start time $t_3$ of the higher priority communication request 3. If end $time_2$ had been later than $t_3$ then communication task 2 would have been re-scheduled, i.e. the scheduler 40 would have sent a message to the requesting task that a new communication request must be made.

In the event that communication task 1 ends shortly after $t_1$; however later than the previous example so that the new end time is later that $t_2$ then again, communication task 2 is re-scheduled, and the communication task of communication request 3 is performed.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

an input transducer configured to output an audio signal based on a signal applied to the input transducer;

a processor configured to compensate a hearing loss of a user of the hearing aid and to output a hearing loss compensated audio signal;

an output transducer configured to output an auditory output signal based on the hearing loss compensated audio signal, wherein the auditory output signal is to be received by a human auditory system;

a wireless communication unit; and an operating system configured to control the wireless communication unit to perform communication with one or more devices, wherein the operating system comprises a scheduler configured to receive communication requests associated with respective communication tasks and to schedule at least one of the communication tasks based on a task priority and a state of a power supply of the hearing aid, and wherein the scheduler is configured to determine a possible start time for performing a next communication task based on a recovery time period for the power supply.

2. The hearing aid according to claim 1, further comprising a capacitor for supplying current to the wireless communication unit.

3. The hearing aid according to claim 2, further comprising the power supply, and a resistor connected between the power supply and the capacitor.

4. A hearing aid comprising:

an input transducer configured to output an audio signal based on a signal applied to the input transducer;

a processor configured to compensate a hearing loss of a user of the hearing aid and to output a hearing loss compensated audio signal;

an output transducer configured to output an auditory output signal based on the hearing loss compensated audio signal, wherein the auditory output signal is to be received by a human auditory system;

a wireless communication unit; and an operating system configured to control the wireless communication unit to perform communication with one or more devices, wherein the operating system comprises a scheduler configured to receive communication requests associated with respective communication tasks and to schedule at least one of the communication tasks based on a task priority and a state of a power supply of the hearing aid;

wherein the scheduler is configured to calculate an earliest possible start time for performing a next communication task based on an estimated power consumption of a current or most recent communication task in order to provide a recovery time period for the power supply.

5. The hearing aid according to claim 4, wherein the recovery time period is a constant multiplied by duration of the current or most recent communication task.

6. The hearing aid according to claim 4, wherein the recovery time period is a function of a current drawn from the power supply during performance of the current or most recent communication task.

7. The hearing aid according to claim 4, wherein the power supply comprises a battery, and wherein the recovery time period is a function of a state of the battery.

8. The hearing aid according to claim 1, wherein at least one of the communication requests contains a priority of one of the communication tasks.

9. The hearing aid according to claim 1, wherein at least one of the communication requests contains a start time for performing one of the communication tasks.

10. The hearing aid according to claim 1, wherein at least one of the communication requests contains a duration of performance for one of the communication tasks.

11. The hearing aid according to claim 1, wherein the scheduler is configured to allow one of the communication tasks with a lower priority to be performed before another one of the communication tasks with a higher priority, provided that the one of the communication tasks with the lower priority will be completed in time for an appropriate recovery time period of the power supply to elapse before start of the other one of the communication tasks with the higher priority.

12. The hearing aid according to claim 1, wherein the scheduler is configured to turn off the communication unit for a sleep time period.

13. The hearing aid according to claim 1, wherein the scheduler is configured to generate a communication indicating that another start time is needed to be requested if a requested start time for one of the communication tasks is not available.

14. The hearing aid according to claim 1, wherein the scheduler is configured to generate a communication indicating that a new start time is needed to be requested if an already scheduled task cannot be performed at a scheduled start time.

15. The hearing aid according to claim 1, wherein the scheduler is configured to also take power consumption of other tasks than wireless communication into account when scheduling.

16. The hearing aid according to claim 1, wherein at least a part of the operating system is contained in the processor.

17. The hearing aid according to claim 1, wherein the power supply comprises a capacitor, and wherein the scheduler is configured to schedule the at least one of the communication tasks based on the task priority and a de-charged state of the capacitor.

18. The hearing aid according to claim 1, wherein the power supply comprises a battery, and wherein the scheduler is configured to schedule the at least one of the communication tasks based on the task priority and a de-charged state of the battery.

* * * * *